US007189087B2

(12) United States Patent
Taguchi

(10) Patent No.: US 7,189,087 B2
(45) Date of Patent: Mar. 13, 2007

(54) CARD CONNECTOR

(75) Inventor: Hidenori Taguchi, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/166,878

(22) Filed: Jun. 24, 2005

(65) Prior Publication Data

US 2005/0287855 A1 Dec. 29, 2005

(30) Foreign Application Priority Data

Jun. 24, 2004 (TW) ..... 93209936 U

(51) Int. Cl.
*H01R 13/62* (2006.01)

(52) U.S. Cl. ..... 439/159

(58) Field of Classification Search ..... 439/159, 439/160

See application file for complete search history.

(56) References Cited

U.S. PATENT DOCUMENTS 6,155,852 A * 12/2000 Ozawa et al. ..... 439/159
6,520,783 B2 * 2/2003 Hsu ..... 439/157
6,554,627 B1 * 4/2003 Chen ..... 439/159
6,592,385 B1 * 7/2003 Chen ..... 439/159
6,652,301 B2 * 11/2003 Harasawa et al. ..... 439/159
6,655,973 B2 * 12/2003 Ji et al. ..... 439/159
6,761,569 B2 7/2004 Nakamura
6,790,061 B1 * 9/2004 Lai et al. ..... 439/159
6,814,596 B2 * 11/2004 Yu et al. ..... 439/159
6,817,874 B2 * 11/2004 Okabe ..... 439/157
6,839,431 B2 * 1/2005 Ooya et al. ..... 379/433.09
6,846,192 B2 * 1/2005 Tien ..... 439/159
6,908,322 B1 * 6/2005 Bricaud et al. ..... 439/152
6,929,491 B1 * 8/2005 Chi-Te ..... 439/159
6,948,960 B1 * 9/2005 Chen ..... 439/159
6,951,471 B1 * 10/2005 Chen ..... 439/159
2004/0067668 A1 * 4/2004 Hirata et al. ..... 439/159

* cited by examiner

*Primary Examiner*—Gary F. Paumen
(74) *Attorney, Agent, or Firm*—Berley Snyder LLC

(57) ABSTRACT

A card connector comprises a main body having a first card accommodating space and a first spring attachment member. An ejection mechanism includes a push block, an ejection bar, and a positioning block. The push block has a second spring attachment member and an abutment member. The abutment member extends into the first card accommodating space for engagement with a card. The positioning block has first and second guide grooves. The ejection bar has a first end attached to the push block and a second end positioned in the first or second guide groove. The second end is capable of following the first and second guide grooves to move the positioning block relative to the push block during insertion and ejection of the card. A spring extends between the first and spring attachment members and biases the push block during insertion and ejection of the card.

12 Claims, 10 Drawing Sheets

CARD CONNECTOR

FIELD OF THE INVENTION

The invention relates to a card connector and, more particularly, to a card connector having an ejection mechanism that rapidly positions and ejects a card.

BACKGROUND OF THE INVENTION

The Personal Computer Memory Card International Association (PCMCIA) interface is a standard specification for computer memory cards. An integrated circuit (IC) card meeting this standard is called a PCMCIA card or PC card, and a socket meeting this standard is called a PCMCIA socket. The PC card is widely used to connect a computer, such as a notebook computer, to its peripheral devices. The PC card is used to transmit data from the notebook computer or as a local area network card so that the user does not have to carry bulky peripheral devices.

For the purpose of providing a better transmission interface, the PCMCIA organization developed an Express card, which is lighter, thinner, faster, easier to use, and suitable for more input/output (I/O) models than the conventional PC card. The Express card has two specifications, i.e., a small card or Express card/34 with a width of 34 millimeters and a big card or Express card/54 with a width of 54 millimeters.

To insert the Express card into a card connector, the Express card is placed in a socket of the card connector, and a user pushes the Express card until it reaches a top of the socket. Because of the different specifications of different cards, the user usually has to take the time to align the card with an end of the socket before inserting the card into the socket. The card therefore can not be rapidly inserted and positioned in the card connector. Moreover, during insertion, the user is required to apply force to the card to push the card into the socket. Since the user can not be certain when the card has been fully inserted into the card connector, the card connector can easily be damaged.

SUMMARY OF THE INVENTION

It is therefore an object of the invention to provide a card connector having an ejection mechanism at a lateral side that rapidly positions and ejects a card.

This and other objects are achieved by a card connector comprising a main body and an ejection mechanism. The main body has a first card accommodating space and a first spring attachment member. The ejection mechanism includes a push block, an ejection bar, and a positioning block. The push block has a second spring attachment member and an abutment member. The abutment member extends into the first card accommodating space for engagement with a card. The positioning block has first and second guide grooves. The ejection bar has a first end attached to the push block and a second end positioned in the first or second guide groove. The second end is capable of following the first and second guide grooves to move the positioning block relative to the push block during insertion and ejection of the card. A spring extends between the first and spring attachment members and biases the push block during insertion and ejection of the card.

This and other objects are further achieved by an ejection mechanism for a card connector comprising a push block, an ejection bar, and a positioning block. The push block has an abutment member for engaging a card. The positioning block has first and second guide grooves. The ejection bar has a first end attached to the push block and a second end positioned in the first or second guide groove. The second end is capable of following the first and second guide grooves to move the positioning block relative to the push block during insertion and ejection of the card. A spring is attached to the push block that biases the push block during insertion and ejection of the card.

DETAILED DESCRIPTION OF THE INVENTION

Figure 1:
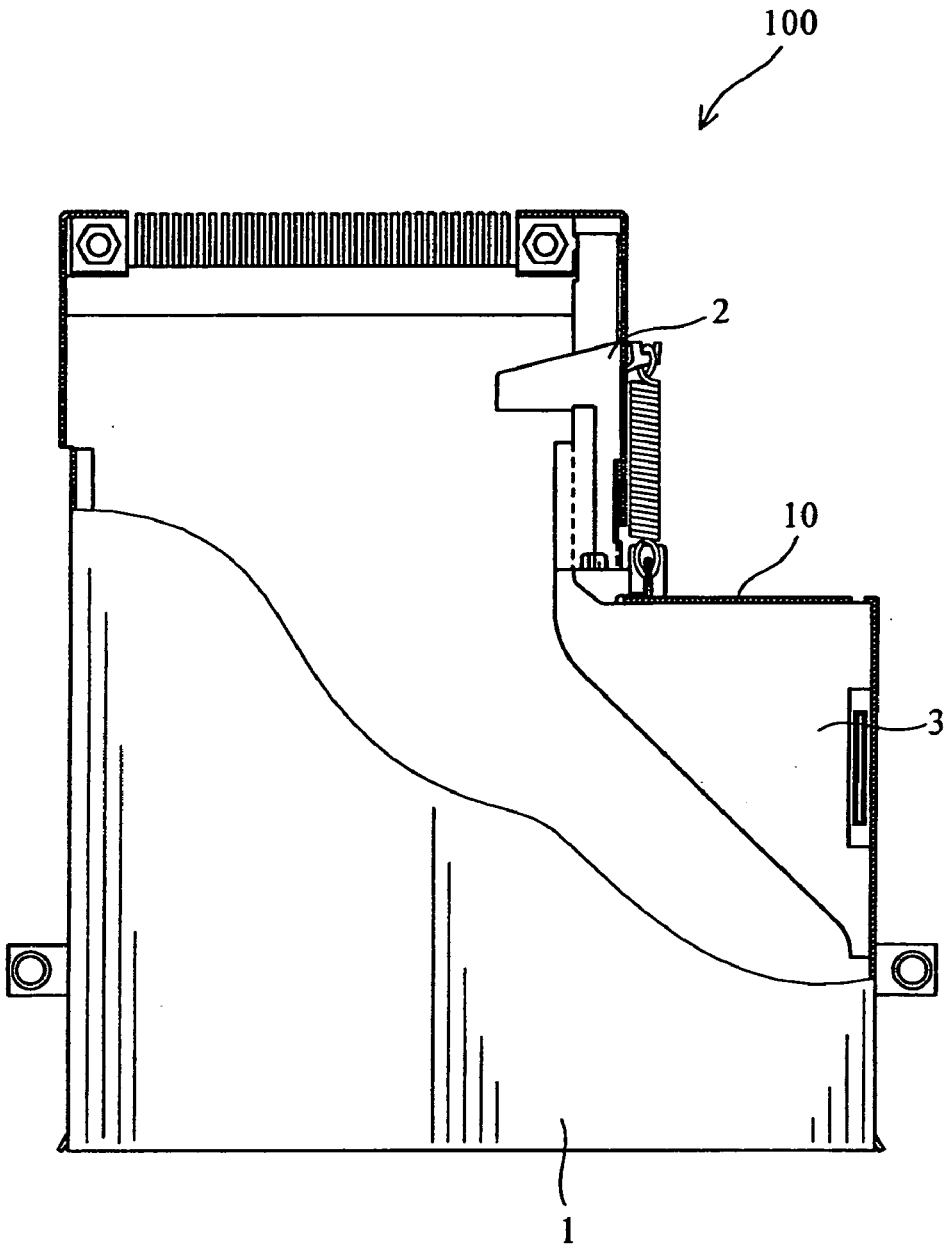
FIG. 1 is a top view of a card connector according to the invention.
Figure 2B:
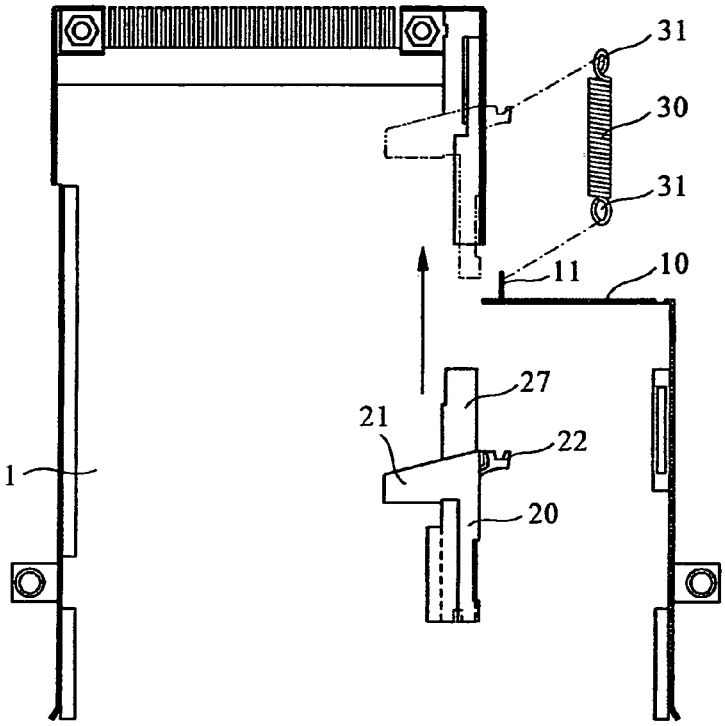
FIG. 2B is a side view of the card connector of FIG. 1.
Figure 2B:
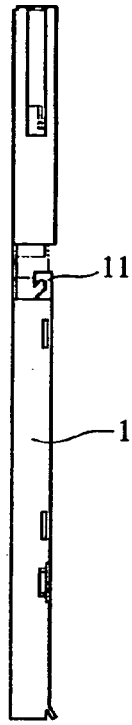
Figure 2A:
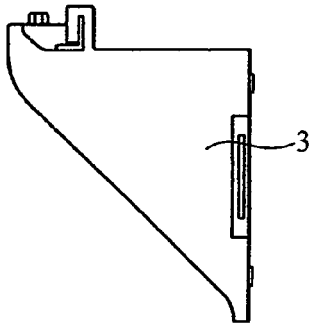
FIG. 2A is an exploded view of the card connector of FIG. 1.

FIG. 1 shows a card connector 100 according to the invention. As shown in FIG. 1, the card connector 100 includes a main body 1, an ejection mechanism 2, and a stopper 3. The main body 1 may be, for example, a composite socket and may be, for example, disposed on a printed circuit board (not shown). A plurality of terminals is provided at a front side of the main body 1. The main body 1 includes a shoulder 10 provided at a lateral side of the main body 1. As shown in FIGS. 2A–2B, shoulder 10 has a first spring attachment member 11. The stopper 3 is disposed at the shoulder 10 and is used to guide a first or second card 4, 5, respectively, into position in the card connector 100.

Figure 3A:
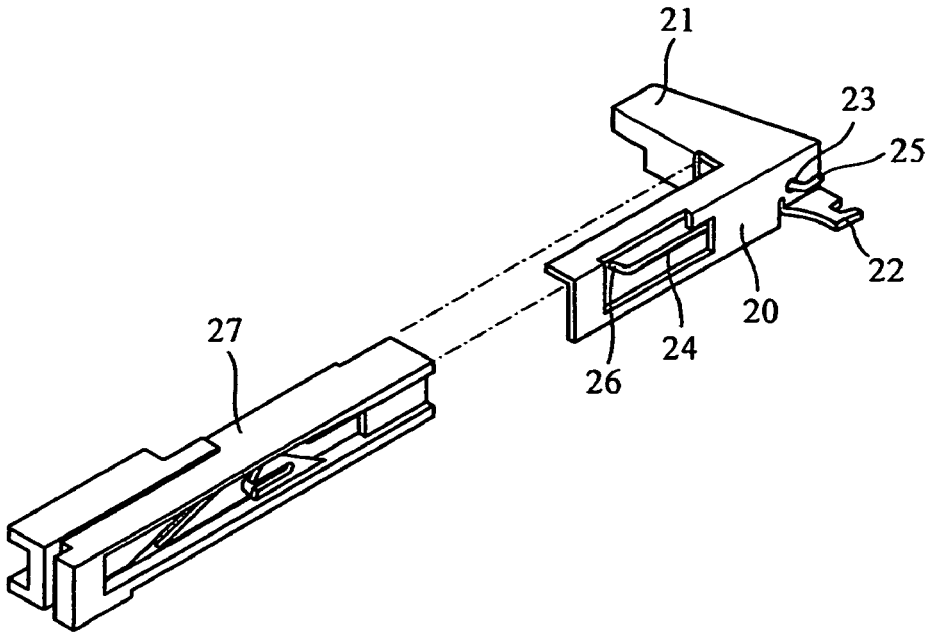
FIG. 3A is an exploded view of an ejection mechanism of the card connector of FIG. 1.
Figure 3B:
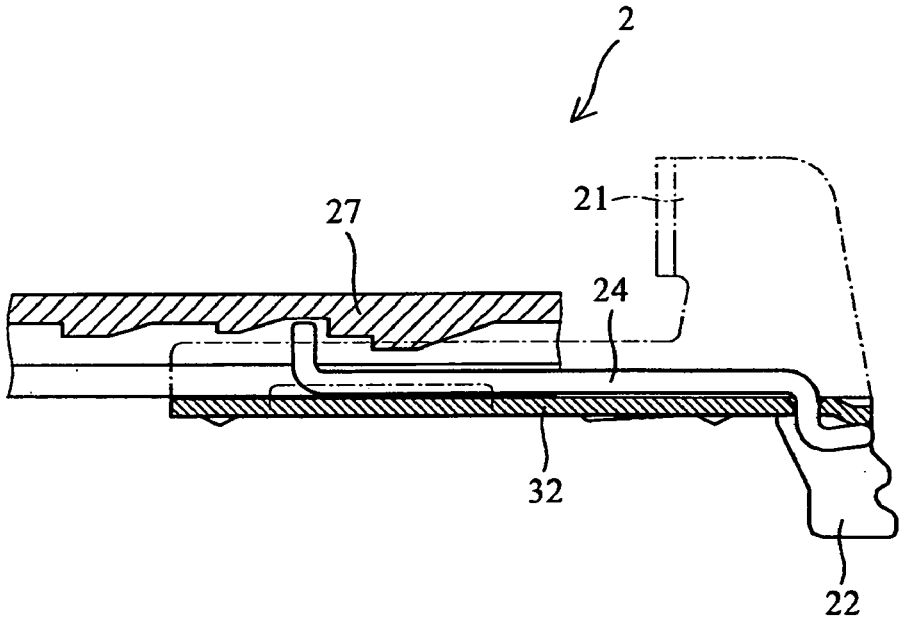
FIG. 3B is a partial cross-sectional view of the ejection mechanism of FIG. 3A.
Figure 3C:
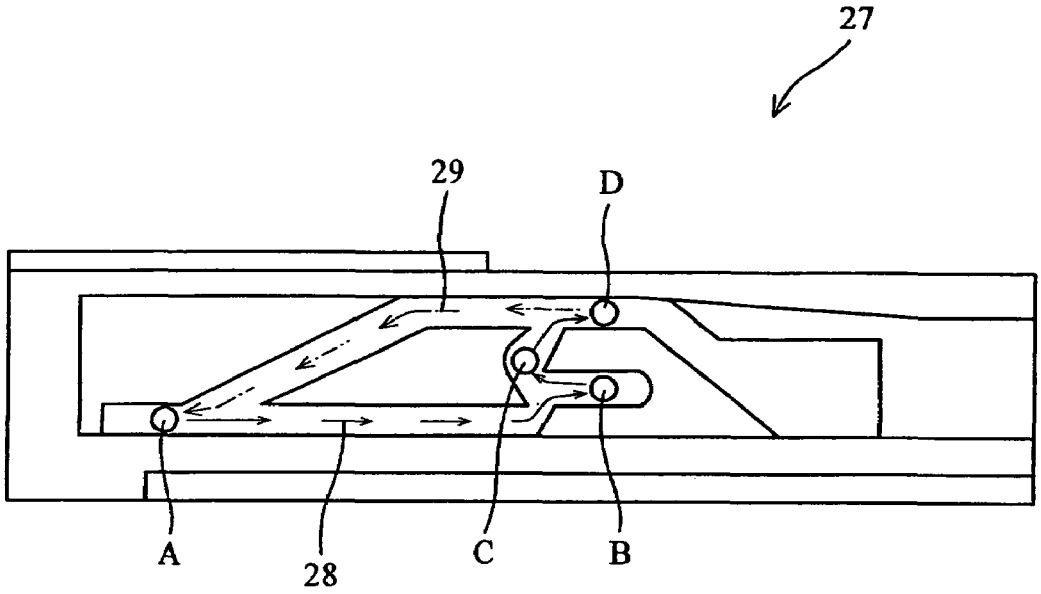
FIG. 3C is a side view of a positioning block of the ejection mechanism of FIG. 3A.

The ejection mechanism 2 is provided at the lateral side of the main body 1 above the shoulder 10. The ejection mechanism 2 is used to either position the first or second card 4, 5 in the card connector 100 or to eject the first or second card 4, 5 from the card connector 100. As shown in FIGS. 2A–3B, the ejection mechanism 2 includes a push block 20, an ejection bar 24, a positioning block 27, and a spring 30. The push block 20 has an abutment member 21 that extends from one side thereof. A second spring attachment member 22 is formed on a side opposite from the abutment member 21. As shown in FIG. 3B, a protruding block 32 extends from an inner wall of the push block 20. As shown in FIG. 3A, a through-hole 23 is formed in the push block 20 above the second spring attachment member portion 22. The ejection bar 24 includes a first end 25 formed as a substantially L-shaped bent portion and a second end 26 formed as a protruding guide portion. As shown in FIG. 3C, the positioning block 27 has a first guide groove 28 and a second guide groove 29 formed on one side thereof. As shown in FIG. 2A, the spring 30 has fastening portions 31 formed at each end thereof.

The first end 25 of the ejection bar 24 passes through the through-hole 23 of the push block 20 such that the ejection bar 24 is associated with the push block 20. The second end 26 of the ejection bar 24 is received in the first guide groove 28, and the protruding block 32 abuts the ejection bar 24 to secure the ejection bar 24 such that the positioning block 27 moves along the inner wall of the push block 20. When assembled, the push block 20 and the positioning block 27 are disposed at the lateral side of the main body 1 above the shoulder 10. One of the fastening portions 31 of the spring 30 is secured to the first spring attachment member 11 on the shoulder 10, and the other one of the fastening portions 31 of the spring 30 is secured to the second spring attachment member 22 of the push block 20 so as to position the push block 20 and the positioning block 27 at the lateral side of the main body 1.

Figure 4:
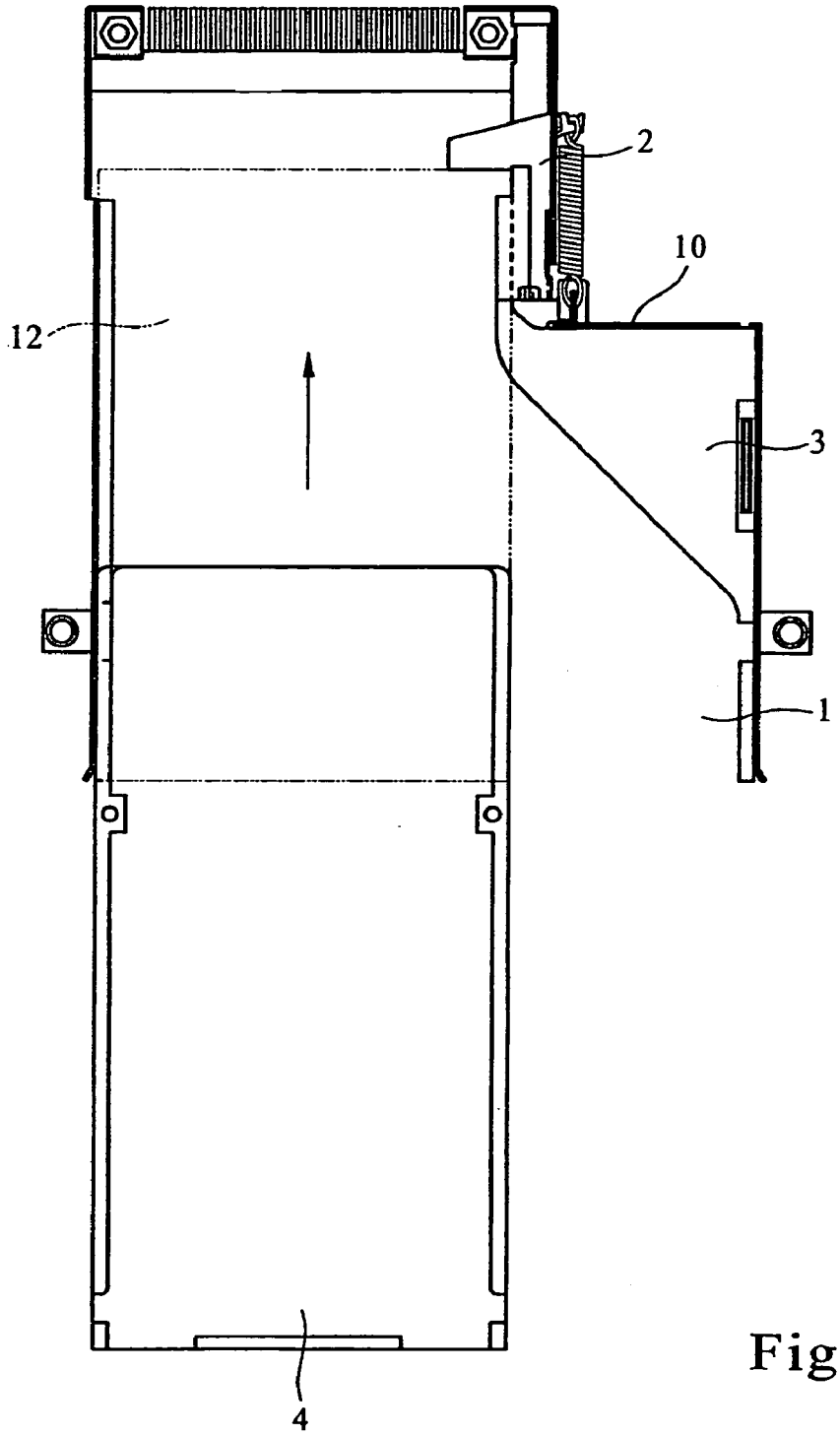
FIG. 4 is a schematic illustration showing the insertion of a first card into the card connector of FIG. 1.
Figure 6:
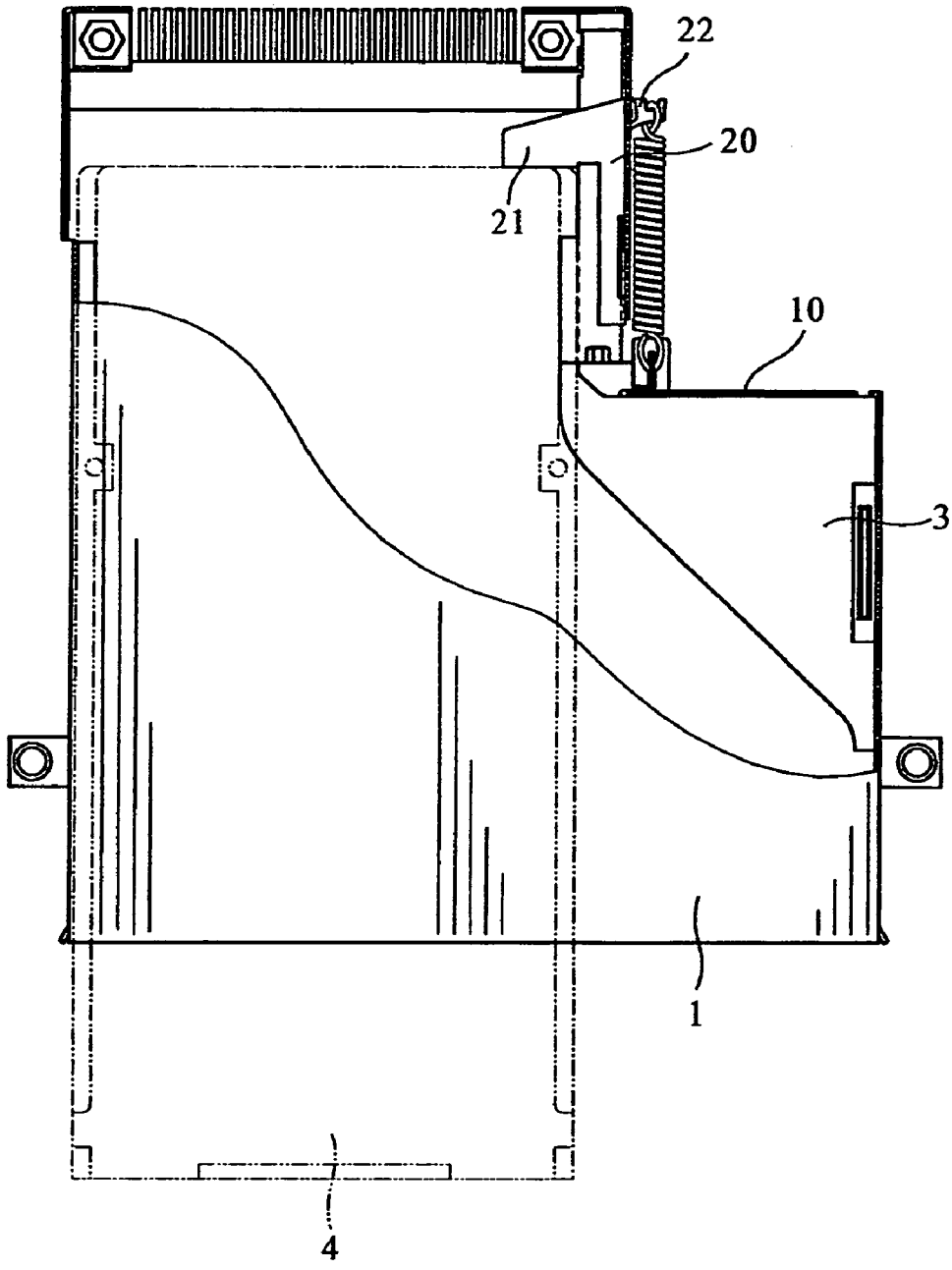
FIG. 6 is a schematic illustration showing the first card accommodated in the card connector of FIG. 1.

The operation of the card connector 100 will now be described. As shown in FIG. 4, a first card 4, such as a small card or Express card/34 with a width of 34 millimeters, is inserted into the card connector 100. The first card 4 is inserted into a first card accommodating space 12 defined by a left-side wall of the main body 1 and the ejection mechanism 2. When the first card 4 is inserted into the card connector 100, a front end of the first card 4 engages the abutment member 21 of the ejection mechanism 2. As a user (not shown) pushes the first card 4 into the card connector 100, the first card 4 pushes the abutment member 21 of the push block 20 toward a front end of the main body 1. The first card 4 pushes the ejection mechanism 2 forward until the first card 4 is positioned in the card connector 100. The spring 30 attached in the second spring attachment member 22 of the ejection mechanism 2 is stretched subject to the movement of the push block 20 and generates a spring force. Simultaneously, the ejection bar 24 moves along the first guide groove 28 from point A along the solid arrows to point B and then to positioning point C, as shown in FIG. 4. FIG. 6 shows the first card 4 accommodated in the card connector 100.

When the first card 4 is to be ejected from the card connector 100, the user (not shown) pushes the first card 4 forward so that the first card 4 pushes the abutment member 21 of the push block 20 and thus the push block 20 toward the top of the main body 1. Subject to the movement of the push block 20, the spring 30 attached in the second spring attachment member of the ejection mechanism 2 generates a spring-back force. Simultaneously, the ejection bar 24 that is attached in the push block 20 moves along the path of the second guide groove 29 from the positioning point C along the dotted arrows to point D and then to the point A, as shown in FIG. 3C. As a result, the first card 4 is ejected from the card connector 100.

Figure 5:
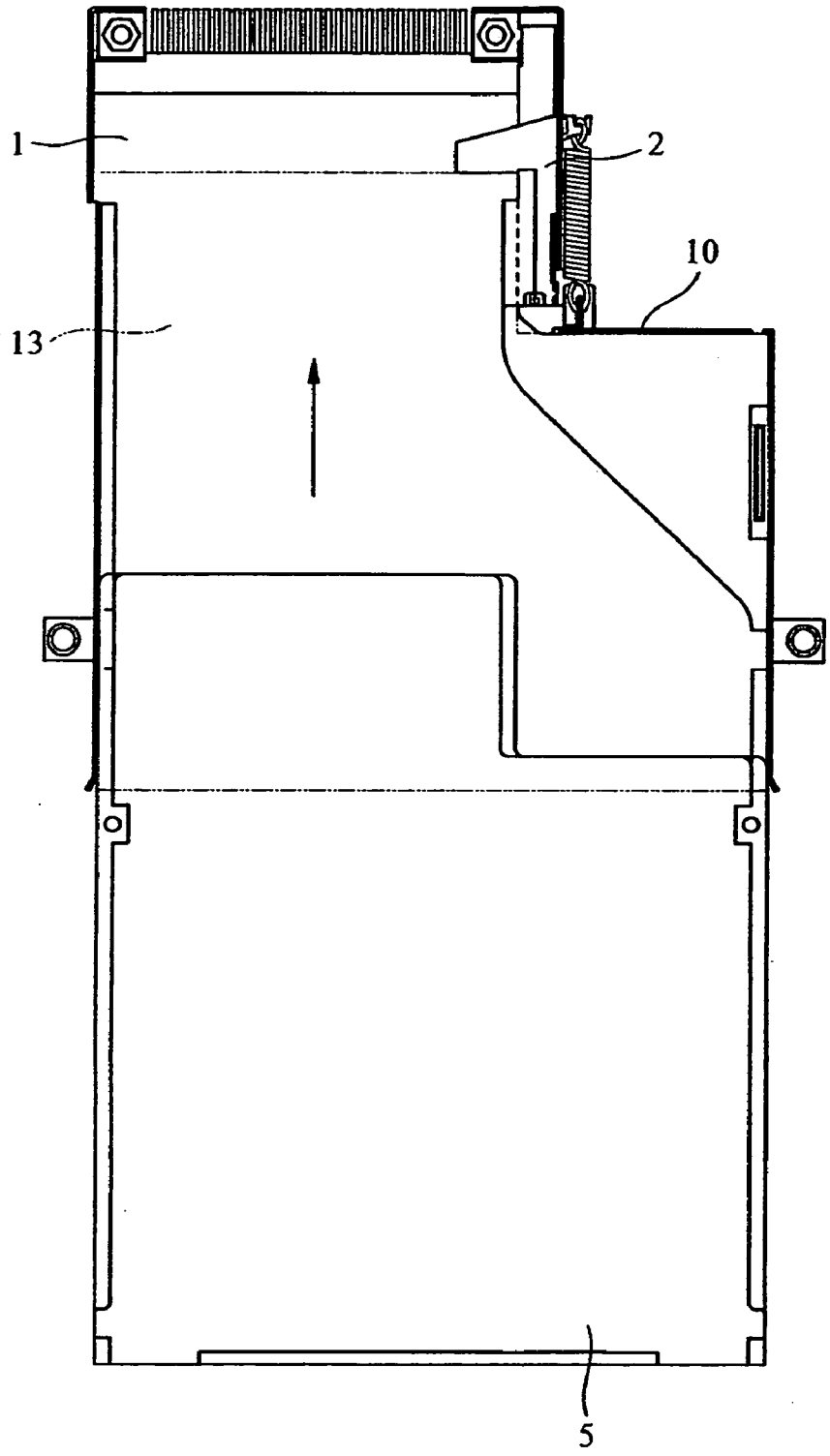
FIG. 5 is a schematic illustration showing the insertion of a second card into the card connector of FIG. 1.

As shown in FIG. 5, a second card accommodating space 13 defined by a front side of the main body 1, the shoulder 10, and the left-side wall of the main body 1 accommodates a second card 5, such as a big card or Express card/54 with a width of 54 millimeters. When the second card 5 is inserted into the second card accommodating space 13, the second card 5 pushes the ejection mechanism 2 forward and the second card 5 is positioned in the card connector 100. The insertion of the second card 5 into the card connector 100 and the ejection of the second card 5 from the card connector 100 are the same as the first card 4, and therefore the operation thereof will not be described further herein.

Figure 7:
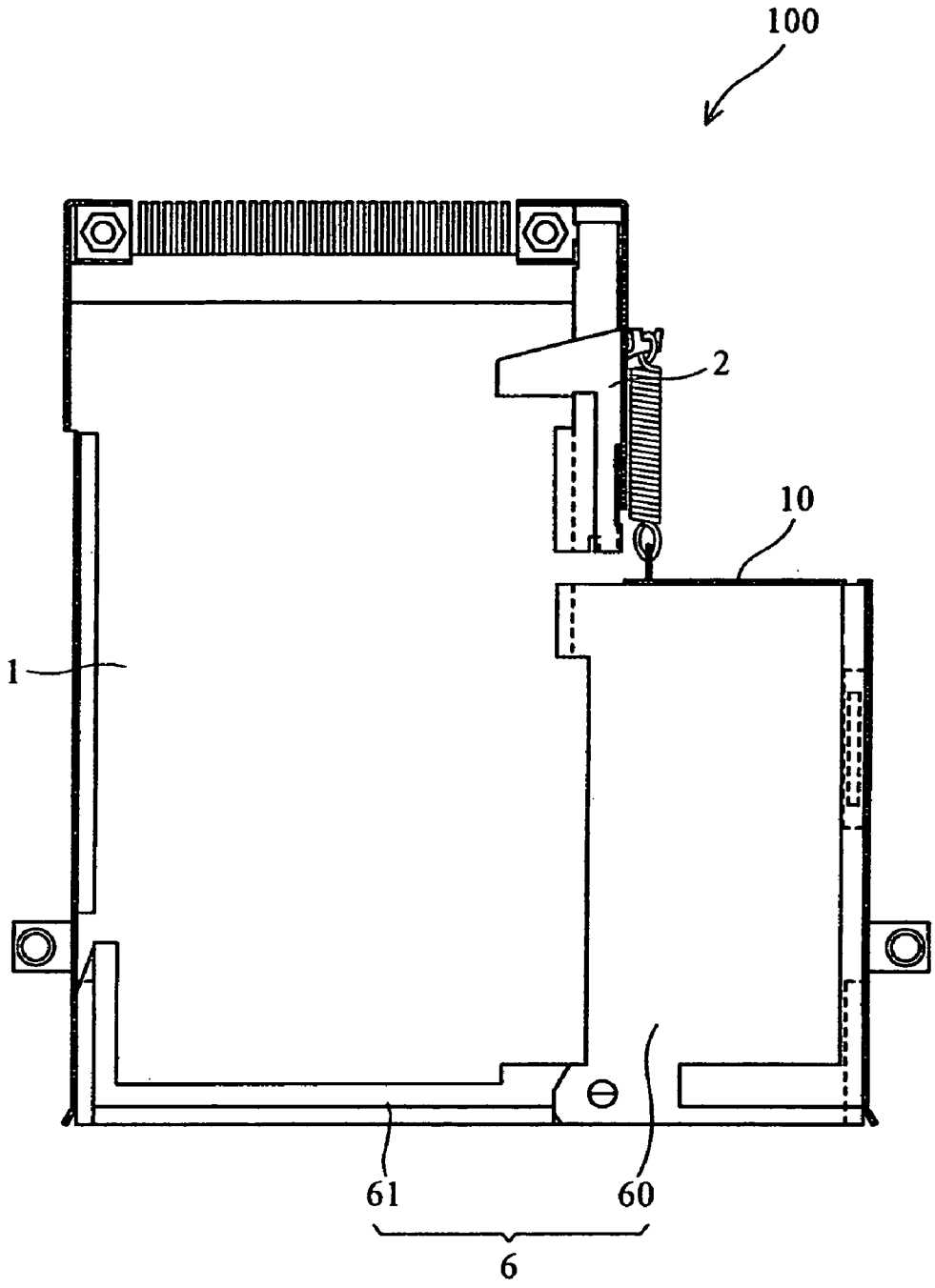
FIG. 7 is a top view of a card connector according to another embodiment of the invention.

FIG. 7 shows a card connector 100 according to another embodiment of the invention. The card connector 100 includes a main body 1, an ejection mechanism 2, and a shield 6. A plurality of terminals is disposed at a front end of the main body 1. A shoulder 10 is provided at a lateral side of the main body. The ejection mechanism 2 is provided at the lateral side of the main body 1 above the shoulder 10. The ejection mechanism 2 is used to either position a first card 4 in the card connector 100 or eject the first card 4 from the card connector 100. The shield 6 has a fixed plate 60 disposed at the shoulder 10 and a substantially L-shaped guide member 61 disposed at an insert end of the main body 1.

Figure 8A:
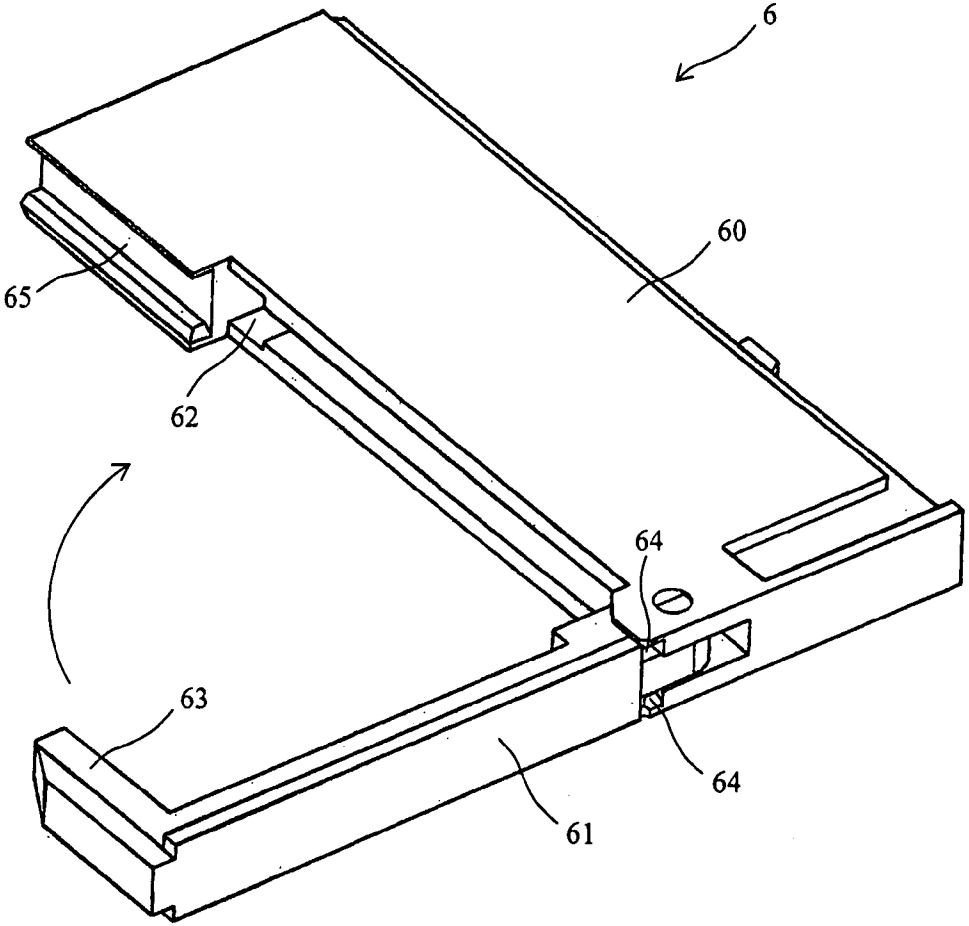
FIG. 8A is a perspective view of a shield of the card connection of FIG. 7.

As shown in FIG. 8A, the guide member 61 is pivotally connected to the fixed plate 60. The fixed plate 60 has a first guide portion 64 formed at a pivot position of the fixed plate 60 and the guide member 61, a second guide portion 65 formed at an end opposite from the first guide portion 64, and a slot 62 formed between the first guide portion 64 and the second guiding portion 65. The first guide portion 64 and the second guide portion 65 guide the first card 4 such that the first card 4 may be rapidly inserted into the card connector 100. The guide member 61 has a vertical extending portion 63 at one end thereof capable of being received in the slot 62.

Figure 8B:
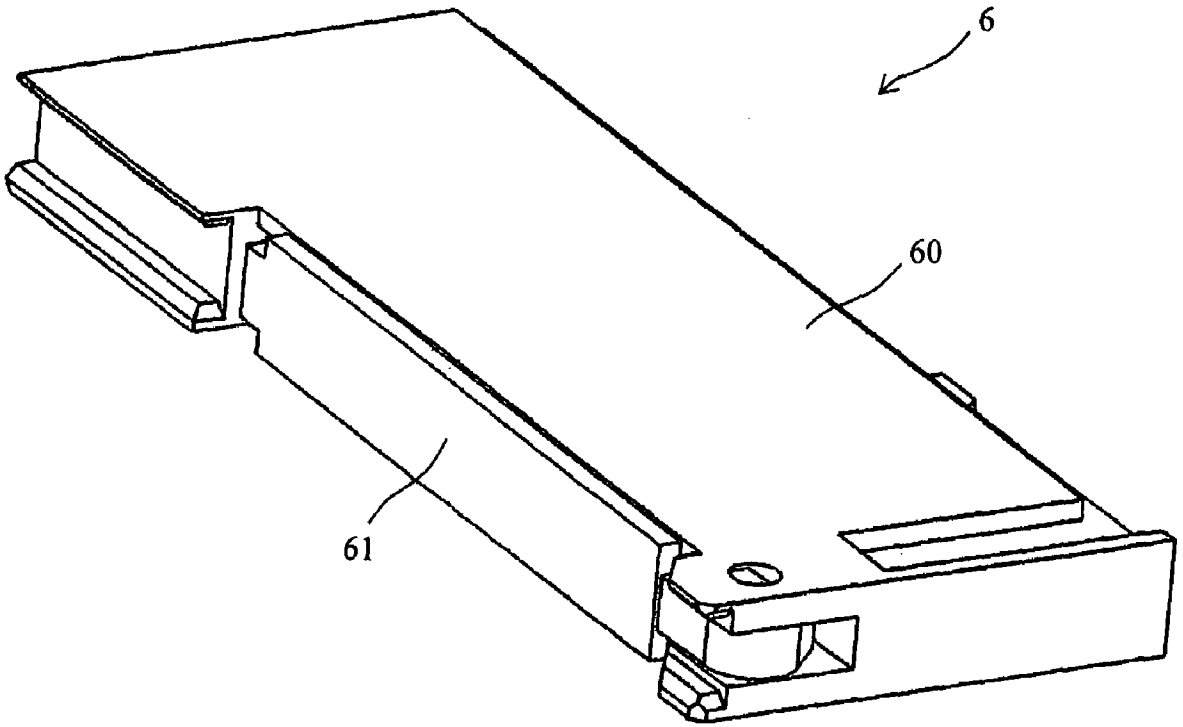
FIG. 8B is another perspective view of the shield mechanism of the card connector of FIG. 7 showing a vertical extending portion received in a slot of the shield.

In this embodiment, the card connector 100 is merely used for accommodating the first card 4, such as a small card or Express card/34 with a width of 34 millimeters. When the first card 4 is to be inserted in the card connector 100, the first guide portion 64 guides the first card 4 to push the guide member 61 forward until the first card reaches the second guide portion 65. At this time, the vertical extending portion 63 is received in the slot 62, as shown in FIG. 8B. The first card 4 continues to move forward along the second guide portion 65 until the first card 4 reaches the ejection mechanism 2. Thereafter, the ejection mechanism 2 positions the first card 4 in the card connector 100.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

I claim:

1. A card connector, comprising:

a main body having a first card accommodating space and a first spring attachment member;

an ejection mechanism including a push block, an ejection bar, and a positioning block;

the push block having a second spring attachment member and an abutment member, the abutment member extending into the first card accommodating space for engagement with a card;

the positioning block having first and second guide grooves;

the ejection bar having a first end attached to the push block and a second end positioned in the first or second guide groove, the second end being capable of following the first and second guide grooves to move the positioning block relative to the push block during insertion and ejection of the card;

a spring extending between the first spring attachment member and the second spring attachment member that biases the push block during insertion and ejection of the card; and a shield having a guide member pivotally attached thereto, the guide member being arranged in the first card accommodating recess such that it pivots upon insertion of the card.

2. The card connector of claim 1, wherein the shield includes a slot that receives the guide member.

3. The card connector of claim 1, wherein the shield includes first and second guide portions for guiding the card.

4. The card connector of claim 1, further comprising a protruding block abutting the ejection bar to secure the ejection bar.

5. The card connector of claim 1, wherein the positioning block slides along an inner surface of the push block.

6. The card connector of claim 1, wherein the push block includes a through-hole that receives the first end of the ejection bar.

7. A card connector, comprising:

a main body having a first card accommodating space and a second card accommodating space, the first card accommodating space being configured to receive a first card and the second card accommodating space being configured to receive a second card having a width larger than the first card; the second card accommodating space being defined by a shoulder extending from a lateral side of the main body;

a stopper arranged at the shoulder for guiding the first and second cards; and an ejection mechanism arranged at the lateral side of the main body above the shoulder, the ejection mechanism including a push block having an abutment member extending into the first card accommodating space for engagement with the first and second cards, a positioning block having first and second guide grooves, an ejection bar having a first end attached to the push block and a second end positioned in the first or second guide groove, the second end being capable of following the first and second guide grooves to move the positioning block relative to the push block during insertion and ejection of the card, and a spring that biases the push block during insertion and ejection of the card.

8. The card connector of claim 7, further comprising a protruding block abutting the ejection bar to secure the ejection bar.

9. The card connector of claim 7, wherein the positioning block slides along an inner surface of the push block.

10. The card connector of claim 7, wherein the push block includes a through-hole that receives the first end of the ejection bar.

11. The card connector of claim 7, wherein the positioning block is integral with the stopper.

12. The card connector of claim 7, wherein the first card accommodating space is defined by a left-side wall of the main body and the ejection mechanism.

* * * * *